US012577032B2

(12) United States Patent
Nwosu

(10) Patent No.: US 12,577,032 B2
(45) Date of Patent: Mar. 17, 2026

(54) CONTAINER FOR RETRIEVABLY STORING SUBSTANCES AND RETAINING TEMPERATURES OF THE SUBSTANCES

(71) Applicant: Arizechukwu Nwosu, Westlake Village, CA (US)

(72) Inventor: Arizechukwu Nwosu, Westlake Village, CA (US)

( * ) Notice: Subject to any disclaimer, the term of this patent is extended or adjusted under 35 U.S.C. 154(b) by 0 days.

(21) Appl. No.: 18/479,835

(22) Filed: Oct. 3, 2023

(65) Prior Publication Data

US 2024/0017909 A1 Jan. 18, 2024

(51) Int. Cl.
*B65D 81/38* (2006.01)
*B65D 25/04* (2006.01)
*B65D 45/30* (2006.01)

(52) U.S. Cl.
CPC ..... *B65D 81/3874* (2013.01); *B65D 25/04* (2013.01); *B65D 45/30* (2013.01); *B65D 2543/00046* (2013.01)

(58) Field of Classification Search
CPC .... B65D 81/3874; B65D 25/04; B65D 45/30; B65D 2543/00046
USPC ..... 220/592.2
See application file for complete search history.

(56) References Cited

U.S. PATENT DOCUMENTS 2,482,779 A * 9/1949 Katz ..... A47J 36/28 126/262
3,459,295 A * 8/1969 Cousar ..... B65D 81/3216 220/592.2
3,705,661 A * 12/1972 Davis ..... A47J 41/02 220/592.16
4,098,397 A * 7/1978 Mann, Jr. ..... A47J 41/0072 206/217
5,392,947 A * 2/1995 Gentile ..... B65D 47/0804 424/44
6,367,652 B1 * 4/2002 Toida ..... B65D 25/2811 220/592.16

(Continued)

FOREIGN PATENT DOCUMENTS

CN 214567130 U * 11/2021 ..... B65D 25/04
CN 114275293 A * 4/2022 ..... B65D 25/04

(Continued)

*Primary Examiner* — Don M Anderson
*Assistant Examiner* — Eric C Baldrighi
(74) *Attorney, Agent, or Firm* — Dhiraj Jindal; PATENT YOGI LLC

(57) ABSTRACT

A container for retrievably storing substances and retaining temperatures of the substances comprises a container body comprising a neck portion and a body portion, and a container cover comprising cover openings. The body portion comprises interior walls and an exterior wall disposed around the interior walls. The interior walls form chambers within the body portion. The neck portion comprises openings in a base wall of the neck portion. The openings lead into the chambers. Each of the interior walls is thermally isolated from the interior walls and the exterior wall. The interior walls and the exterior wall thermally isolate a substance for retaining a temperature of the substance stored in each of the chambers. The cover openings couple with the openings based on coupling the container cover with the neck portion. The container cover allows an independent retrieval of the substances from the chambers through the cover openings.

17 Claims, 13 Drawing Sheets

(56) References Cited

U.S. PATENT DOCUMENTS 6,571,977 B2 * 6/2003 Goncalez ..... B65D 1/04 220/633
6,895,778 B1 * 5/2005 Ackerman ..... F25D 23/069 62/457.7
8,746,475 B2 * 6/2014 Kountotsis ..... B65D 1/04 215/396
8,875,874 B2 * 11/2014 Helou, Jr. ..... B65D 81/3222 206/219
10,549,902 B1 * 2/2020 Brown, II ..... B65D 43/022
10,661,970 B2 * 5/2020 Yamashita ..... A47J 41/022
2003/0168459 A1 * 9/2003 Fujii ..... A47J 41/0077 220/592.2
2006/0151496 A1 * 7/2006 Healy ..... B65D 81/3283 220/23.83
2007/0000930 A1 * 1/2007 Kim ..... A47J 39/00 206/541
2008/0006642 A1 * 1/2008 Hidary ..... B65D 81/382 220/592.2
2009/0127263 A1 * 5/2009 Hylton ..... A47G 19/23 220/507
2010/0224510 A1 * 9/2010 Ford ..... B65B 7/2835 126/263.01
2011/0056233 A1 * 3/2011 Flaker ..... F25D 3/08 220/592.2
2012/0187066 A1 * 7/2012 Redl ..... A47J 41/0038 215/11.2
2013/0008909 A1 * 1/2013 Terracciano ..... A47J 39/02 220/592.2
2013/0221013 A1 * 8/2013 Kolowich ..... A61J 9/00 220/592.17
2013/0306656 A1 * 11/2013 Eckhoff ..... F25D 3/125 62/304
2014/0157795 A1 * 6/2014 Joseph ..... F25D 5/02 126/263.01
2019/0315550 A1 * 10/2019 Romo ..... B65D 85/816
2020/0223589 A1 * 7/2020 Wondka ..... B65D 47/06

FOREIGN PATENT DOCUMENTS

GB 2447234 A * 9/2008 ..... A47G 19/2288
KR 200419437 Y1 * 6/2006 ..... A47G 19/2205
KR 101079398 B1 * 11/2011 ..... B65D 25/20
KR 200480733 Y1 * 7/2016 ..... B65D 81/38
TW M505856 U * 8/2015 ..... A45F 3/16
WO WO-2022099998 A1 * 5/2022 ..... B65D 25/04

* cited by examiner

CONTAINER FOR RETRIEVABLY STORING SUBSTANCES AND RETAINING TEMPERATURES OF THE SUBSTANCES

FIELD OF THE INVENTION

Generally, the present disclosure relates to the field of packages and containers for goods. More specifically, the present disclosure relates to a container for retrievably storing substances and retaining temperatures of the substances.

BACKGROUND OF THE INVENTION

In the realm of portable beverage containers, the problem of carrying and enjoying multiple drinks simultaneously while preserving their unique flavors and temperatures has been a persistent challenge. The solutions known in the art have often revolved around carrying multiple separate bottles, which leads to inconvenience, added bulk, and potential flavor mixing. While some products attempted to incorporate dual compartments, they often lacked effective temperature control and seamless design, making them less practical for daily use.

The historical approaches to solving the issue of carrying multiple beverages presented their own set of drawbacks. Carrying separate bottles not only occupied more space but also increased the risk of spills and compromised convenience. While some dual-compartment containers existed, their limitations in temperature maintenance and complex designs hindered their user-friendliness. Therefore, a different solution is needed that offers a harmonious blend of dual-compartment convenience, temperature control, and elegant design that has remained unfulfilled. In addition, a comprehensive solution is needed that addresses the inconveniences of carrying multiple beverage containers, while ensuring optimal taste and temperature maintenance, is evident.

Therefore, there is a need for a container for retrievably storing substances and retaining temperatures of the substances that may overcome one or more of the above-mentioned problems and/or limitations.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

Disclosed herein is a container for retrievably storing substances and retaining temperatures of the substances, in accordance with some embodiments. Accordingly, the container may include a container body and a container cover. Further, the container body may include a neck portion and a body portion. Further, the body portion may include a plurality of interior walls and an exterior wall disposed around the plurality of interior walls. Further, the plurality of interior walls forms a plurality of chambers within the body portion. Further, the neck portion may include a plurality of openings corresponding to the plurality of chambers in a base wall of the neck portion. Further, the plurality of openings leads into the plurality of chambers corresponding to the plurality of openings. Further, each of the plurality of interior walls may be thermally isolated from the plurality of interior walls and the exterior wall. Further, the plurality of chambers may be configured for storing a plurality of substances in the plurality of chambers received through the plurality of openings. Further, the plurality of interior walls and the exterior wall thermally isolate each of the plurality of substances stored in each of the plurality of chambers from the plurality of substances stored in the plurality of chambers and an exterior of the body portion for retaining a temperature of each of the plurality of substances. Further, the container cover may be configured to be coupled with the neck portion of the container body. Further, the container cover may include a plurality of cover openings. Further, the plurality of cover openings couples with the plurality of openings based on the coupling of the container cover with the neck portion. Further, the container cover may be configured for allowing an independent retrieval of the plurality of substances from the plurality of chambers through the plurality of cover openings.

Further, disclosed herein is a container for retrievably storing substances and retaining temperatures of the substances, in accordance with some embodiments. Accordingly, the container may include a container body and a container cover. Further, the container body may include a neck portion and a body portion. Further, the body portion may include a plurality of interior walls and an exterior wall disposed around the plurality of interior walls. Further, the plurality of interior walls forms a plurality of chambers within the body portion. Further, the neck portion may include a plurality of openings corresponding to the plurality of chambers in a base wall of the neck portion. Further, the plurality of openings leads into the plurality of chambers corresponding to the plurality of openings. Further, each of the plurality of interior walls may be thermally isolated from the plurality of interior walls and the exterior wall. Further, the plurality of chambers may be configured for storing a plurality of substances in the plurality of chambers received through the plurality of openings. Further, the plurality of interior walls and the exterior wall thermally isolate each of the plurality of substances stored in each of the plurality of chambers from the plurality of substances stored in the plurality of chambers and an exterior of the body portion for retaining a temperature of each of the plurality of substances. Further, each of the plurality of interior walls may be spaced from the plurality of interior walls and the exterior wall defining a space around an exterior of each of the plurality of chambers. Further, each of the plurality of interior walls may be thermally isolated from the plurality of interior walls and the exterior wall based on the space around the exterior of each of the plurality of chambers. Further, the container cover may be configured to be coupled with the neck portion of the container body. Further, the container cover may include a plurality of cover openings. Further, the plurality of cover openings couples with the plurality of openings based on the coupling of the container cover with the neck portion. Further, the container cover may be configured for allowing an independent retrieval of the plurality of substances from the plurality of chambers through the plurality of cover openings.

Further, disclosed herein is a container for retrievably storing substances and retaining temperatures of the substances, in accordance with some embodiments. Accordingly, the container may include a container body and a container cover. Further, the container body may include a neck portion and a body portion. Further, the body portion may include a plurality of interior walls and an exterior wall disposed around the plurality of interior walls. Further, the plurality of interior walls forms a plurality of chambers within the body portion. Further, the neck portion may include a plurality of openings corresponding to the plurality of chambers in a base wall of the neck portion. Further, the plurality of openings leads into the plurality of chambers corresponding to the plurality of openings. Further, each of the plurality of interior walls may be thermally isolated from the plurality of interior walls and the exterior wall. Further, the plurality of chambers may be configured for storing a plurality of substances in the plurality of chambers received through the plurality of openings. Further, the plurality of interior walls and the exterior wall thermally isolate each of the plurality of substances stored in each of the plurality of chambers from the plurality of substances stored in the plurality of chambers and an exterior of the body portion for retaining a temperature of each of the plurality of substances. Further, each of the plurality of interior walls may be spaced from the plurality of interior walls and the exterior wall defining a space around an exterior of each of the plurality of chambers. Further, each of the plurality of interior walls may be thermally isolated from the plurality of interior walls and the exterior wall based on the space around the exterior of each of the plurality of chambers. Further, the container cover may be configured to be coupled with the neck portion of the container body. Further, the container cover may include a plurality of cover openings. Further, the plurality of cover openings couples with the plurality of openings based on the coupling of the container cover with the neck portion. Further, the container cover may be configured for allowing an independent retrieval of the plurality of substances from the plurality of chambers through the plurality of cover openings. Further, the container cover may include a plurality of mechanisms coupled with the plurality of cover openings. Further, the plurality of mechanisms may be configured for transitioning the plurality of cover openings between a closed state and an opened state. Further, the plurality of mechanisms restricts the independently retrieving from the plurality of cover openings in the closed state. Further, the plurality of mechanisms allows the independently retrieving from the plurality of cover openings in the opened state.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAIL DESCRIPTIONS OF THE INVENTION

Figure 1:
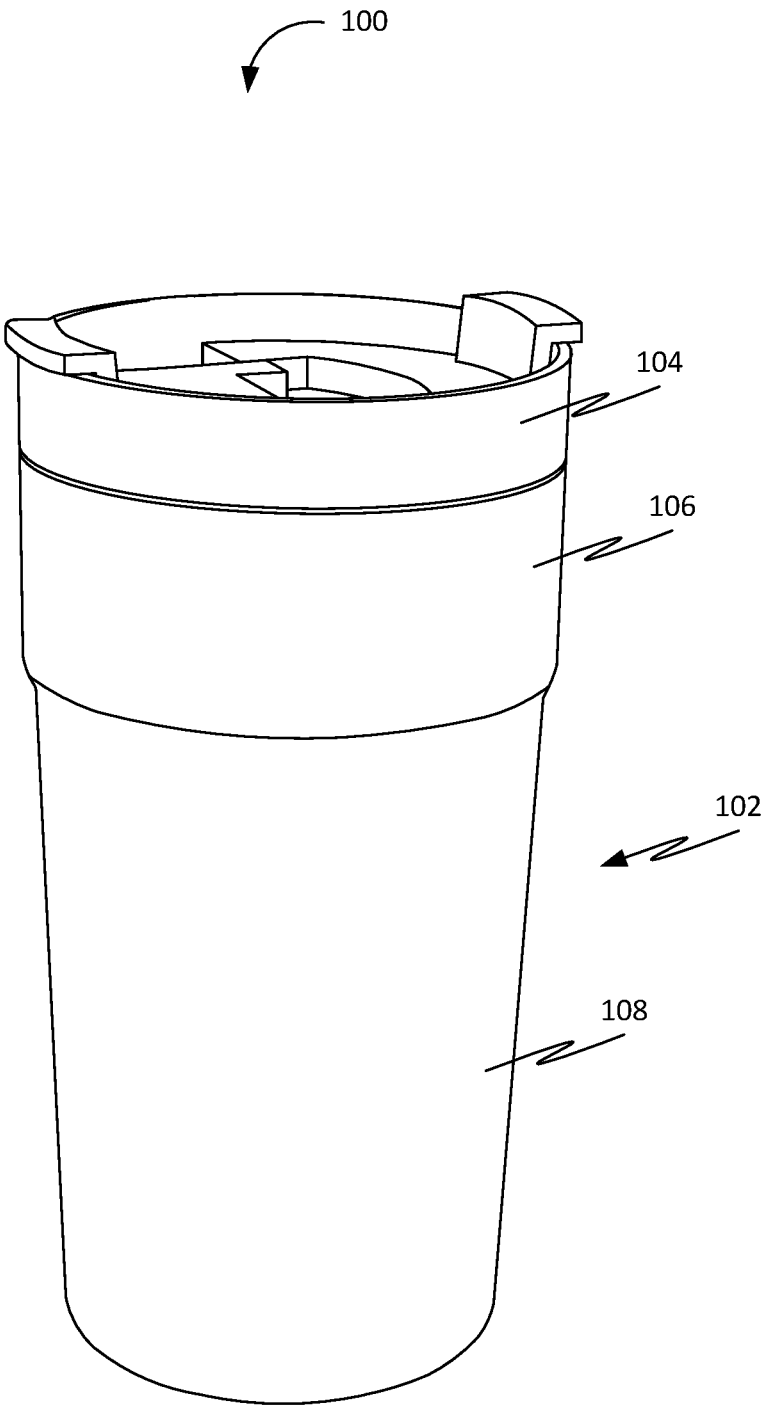
FIG. 1 is a side perspective view of a container 100 for retrievably storing substances and retaining temperatures of the substances, in accordance with some embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of a container for retrievably storing substances and retaining temperatures of the substances, embodiments of the present disclosure are not limited to use only in this context.

Overview:

The present disclosure describes a container for retrievably storing substances and retaining temperatures of the substances. Further, the container is an innovative dual-chamber beverage container designed to allow users to carry and enjoy two different drinks simultaneously while maintaining their distinct temperatures and flavors.

Further, the container may be a SplitFlask that ingeniously combines a dual-compartment design with advanced thermal insulation. The SplitFlask ensures each beverage remains isolated in its compartment to maintain the distinct flavors of the beverages. Additionally, the independent insulation of each compartment guarantees the desired temperatures for hours. Further, the SplitFlask presents a comprehensive solution that redefines convenience, taste preservation, and aesthetic appeal in the realm of beverage containers. Further, the SplitFlask is a dual-chamber beverage container that reimagines the way people carry and enjoy their drinks. With a sleek and compact design, SplitFlask's innovation lies in its ability to hold two different beverages in separate compartments while keeping their individual temperatures and flavors intact. Each compartment of the SplitFlask is thermally insulated, allowing one side to hold a hot drink like coffee, while the other side keeps a cold beverage like iced tea refreshingly chilled. This unique dual-chamber design eliminates the need to carry multiple bottles therefore reducing bulk and inconvenience. Further, the SplitFlask includes a dual-sip cover that enables users to independently enjoy each drink without any mixing or compromise. This intuitive design of the SplitFlask allows for easy and on-the-go sips while maintaining the integrity of both beverages. The SplitFlask's ergonomic shape ensures a comfortable grip, and its measurements have been meticulously calculated to fit into standard car cup holders and bags thereby enhancing its portability.

Further, the present disclosure describes the SplitFlask that has a dual-chamber design that enables users to carry two separate beverages simultaneously. Further, the SplitFlask eliminates the need for multiple bottles therefore streamlining on-the-go hydration. Further, the SplitFlask includes independent thermal insulation for each compartment of the SplitFlask. Further, the SplitFlask ensures that hot beverages that are stored in the compartments stay hot and cold beverages that are stored in the compartments stay cold for extended periods. Further, the SplitFlask maintains optimal temperatures for both types of drinks. The SplitFlask's dual-compartment architecture preserves the individual flavors of each beverage. Further, the SplitFlask includes a dual-sip cover that allows users to enjoy each beverage independently without any flavor crossover. The SplitFlask's sleek design and ergonomic shape enhance its portability, making the SplitFlask an ideal companion for car cup holders and bags. With SplitFlask, users can have both of their preferred beverages at hand therefore optimizing their hydration routine while focusing on their daily tasks. Further, the SplitFlask offers users a superior, more efficient, and enjoyable way to carry, store, and enjoy their drinks.

Further, the present disclosure describes the SplitFlask that has a dual-chamber design that allows two different beverages to be carried simultaneously in each of the SplitFlask isolated compartments. Further, the SplitFlask includes independent thermal insulation for each chamber of the SplitFlask for maintaining the desired temperature of each beverage without interference. Further, the SplitFlask maintains separate temperatures in each compartment. Further, the SplitFlask includes a dual-sip cover that enables users to drink from each compartment of the SplitFlask separately therefore preventing mixing of flavors of the beverages while enhancing convenience. Further, the SplitFlask includes an ergonomic shape. Further, the ergonomic design of the SplitFlask ensures that the SplitFlask has a comfortable grip and fits seamlessly into car cup holders and bags. Further, the SplitFlask is aesthetically designed. Further, the overall aesthetic and visual appeal of SplitFlask are essential aspects of the SplitFlask as they add a layer of style to the SplitFlask's functionality. Further, SplitFlask's compatibility with standard car cup holders and bags enhances SplitFlask's usability. Further, the SplitFlask is constructed using specific materials and the manufacturing process, which play a significant role in SplitFlask's functionality and durability.

Further, the present disclosure describes a thermal flask with two separate chambers that are vacuum insulated from each other. Therefore, each chamber can preserve the temperature of the liquid inside them for hours without much change of temperature in each chamber.

Further, the present disclosure describes a container that allows keeping two opposite temperatures of foods or any substances in the container without compromising the temperature of either of those foods or substances.

FIG. 1 is a side perspective view of a container 100 for retrievably storing substances and retaining temperatures of the substances, in accordance with some embodiments. Accordingly, the container 100 may include a container body 102 and a container cover 104. Further, the container 100 may be a SplitFlask. Further, the container 100 may include a bottle, a box, a jar, a vessel, etc.

Figure 2:
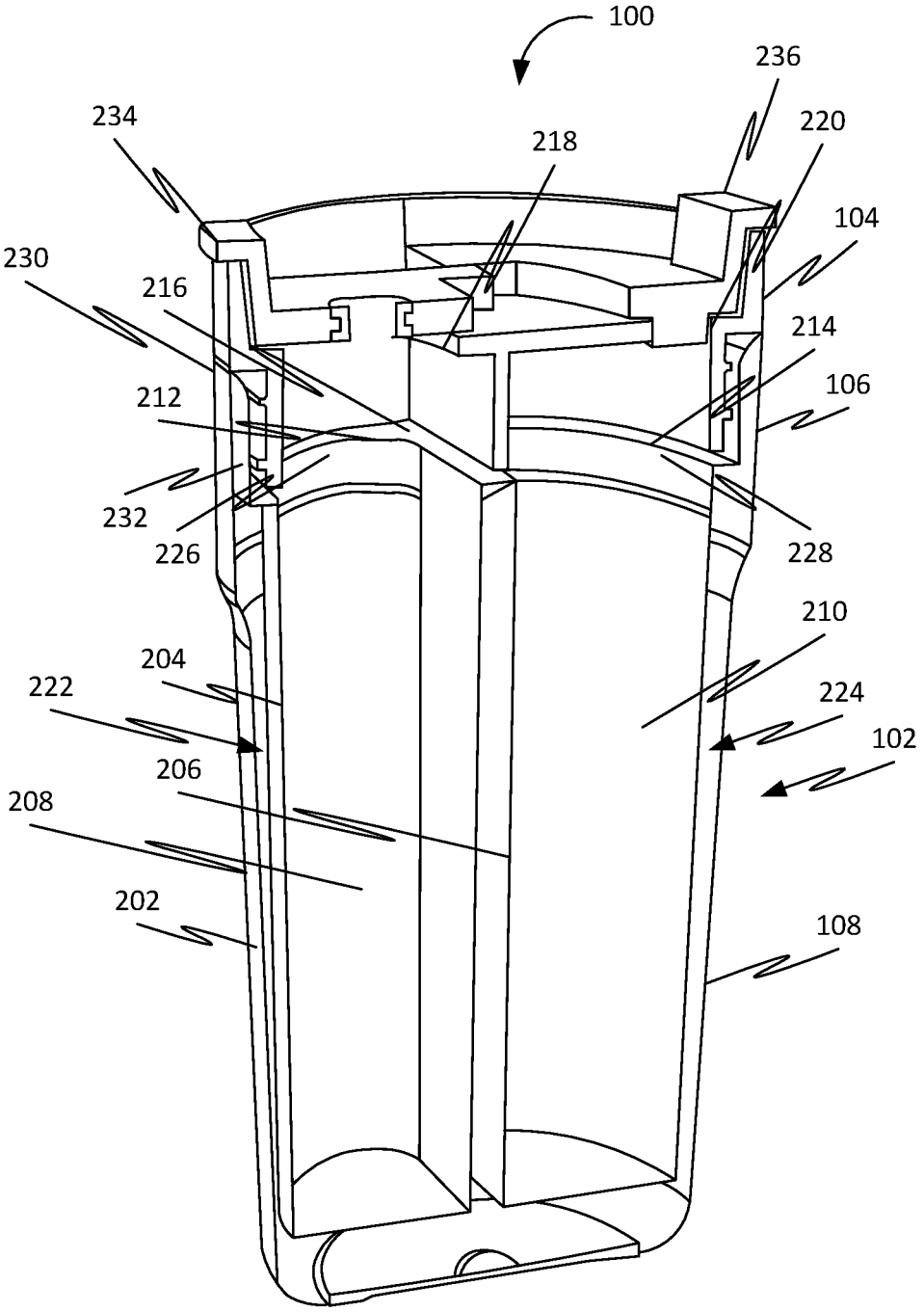
FIG. 2 is a side perspective cross-sectional view of the container 100, in accordance with some embodiments.

Further, the container body 102 may include a neck portion 106 and a body portion 108. Further, the body portion 108 may include a plurality of interior walls 204-206 and an exterior wall 202 disposed around the plurality of interior walls 204-206, as shown in FIG. 2. Further, the plurality of interior walls 204-206 forms a plurality of chambers 208-210 within the body portion 108, as shown in FIG. 2. Further, each of the plurality of interior walls 204-206 may be shaped in at least one closed configuration for forming each of the plurality of chambers 208-210. Further, each of the plurality of chambers 208-210 may be a hollow body having an internal volume with an open top. Further, the plurality of chambers 208-210 may be independent. Further, the plurality of chambers 208-210 may include compartments, receptacles, vessels, etc. Further, the neck portion 106 may include a plurality of openings 212-214 corresponding to the plurality of chambers 208-210 in a base wall 216 of the neck portion 106, as shown in FIG. 2. Further, the plurality of openings 212-214 leads into the plurality of chambers 208-210 corresponding to the plurality of openings 212-214. Further, each of the plurality of interior walls 204-206 may be thermally isolated from the plurality of interior walls 204-206 and the exterior wall 202. Further, the plurality of chambers 208-210 may be configured for storing a plurality of substances in the plurality of chambers 208-210 received through the plurality of openings 212-214. Further, the plurality of substances comprising food items, beverages, etc. Further, the plurality of substances may include solid substances, liquid substances, etc. Further, the plurality of interior walls 204-206 and the exterior wall 202 thermally isolate each of the plurality of substances stored in each of the plurality of chambers 208-210 from the plurality of substances stored in the plurality of chambers 208-210 and an exterior of the body portion 108 for retaining a temperature of each of the plurality of substances. Further, the retaining of the temperature may be based on thermally isolating each of the plurality of substances stored in each of the plurality of chambers 208-210 from the plurality of substances stored in the plurality of chambers 208-210 and an exterior of the body portion 108. Further, the exterior wall 202 may include a base wall portion and a side wall portion circumferentially extending from the base wall portion for forming an exterior container. Further, the base portion and the side wall portion of the exterior wall 202 define an interior space of the exterior container. Further, an edge of the side wall portion of the exterior wall 202 defines an opening leading into the interior space of the exterior wall 202. Further, each of the plurality of interior walls 204-206 may include a base wall portion and a side wall portion circumferentially extending from the base wall portion for forming an interior container. Further, the base portion and the side wall portion of each of the plurality of interior walls 204-206 define an interior space of the interior container. Further, an edge of the side wall portion of each of the plurality of interior walls 204-206 defines an opening leading into the interior space of each of the plurality of interior walls 204-206. Further, the interior container may be disposed in the interior space of the exterior container.

Further, the container cover 104 may be configured to be coupled with the neck portion 106 of the container body 102. Further, the container cover 104 may include a plurality of cover openings 218-220, as shown in FIG. 2. Further, the plurality of cover openings 218-220 couples with the plurality of openings 212-214 based on the coupling of the container cover 104 with the neck portion 106. Further, the container cover 104 may snugly fit in a recess of the neck portion 106 using an interference fit. Further, the container cover 104 may be configured for allowing an independent retrieval of the plurality of substances from the plurality of chambers 208-210 through the plurality of cover openings 218-220.

Further, in some embodiments, each of the plurality of interior walls 204-206 may be spaced from the plurality of interior walls 204-206 and the exterior wall 202 defining a space (222 and 224) around an exterior of each of the plurality of chambers 208-210, as shown in FIG. 2. Further, each of the plurality of interior walls 204-206 may be thermally isolated from the plurality of interior walls 204-206 and the exterior wall 202 based on the space (222 and 224) around the exterior of each of the plurality of chambers 208-210. Further, in an embodiment, a terminal end (226 and 228) of each of the plurality of interior walls 204-206 may be attached to the base wall 216 peripherally around each of the plurality of openings 212-214 and a terminal end 230 of the exterior wall 202 may be attached to a side wall 232 of the neck portion 106 for hermetically sealing the space (222 and 224) around the exterior of each of the plurality of chambers 208-210, as shown in FIG. 2.

Further, in an embodiment, the space (222 and 224) around the exterior of each of the plurality of chambers 208-210 may be a vacuum space. Further, each of the plurality of interior walls 204-206 may be thermally isolated from the plurality of interior walls 204-206 and the exterior wall 202 based on the vacuum space.

Figure 3:
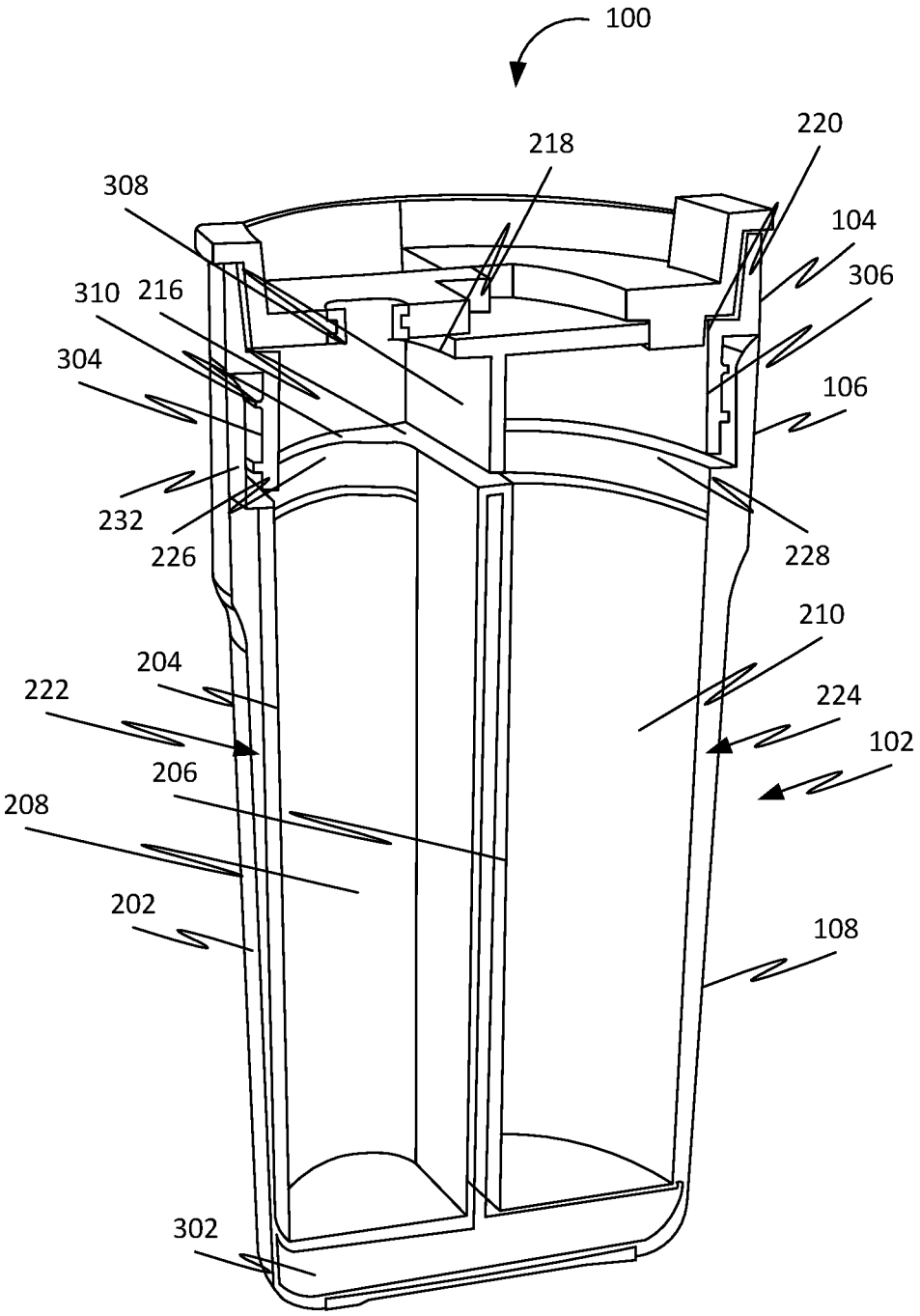
FIG. 3 is a side perspective cross-sectional view of the container 100, in accordance with some embodiments.

In an embodiment, the container 100 may include at least one thermally insulating material 302 disposed in the space (222 and 224), as shown in FIG. 3. Further, each of the plurality of interior walls 204-206 may be thermally isolated from the plurality of interior walls 204-206 and the exterior wall 202 based on the at least one thermally insulating material 302 disposed in the space (222 and 224). Further, the at least one thermally insulating material 302 may include polystyrene foam, mineral wool, polyurethane foam, etc.

Figure 7:
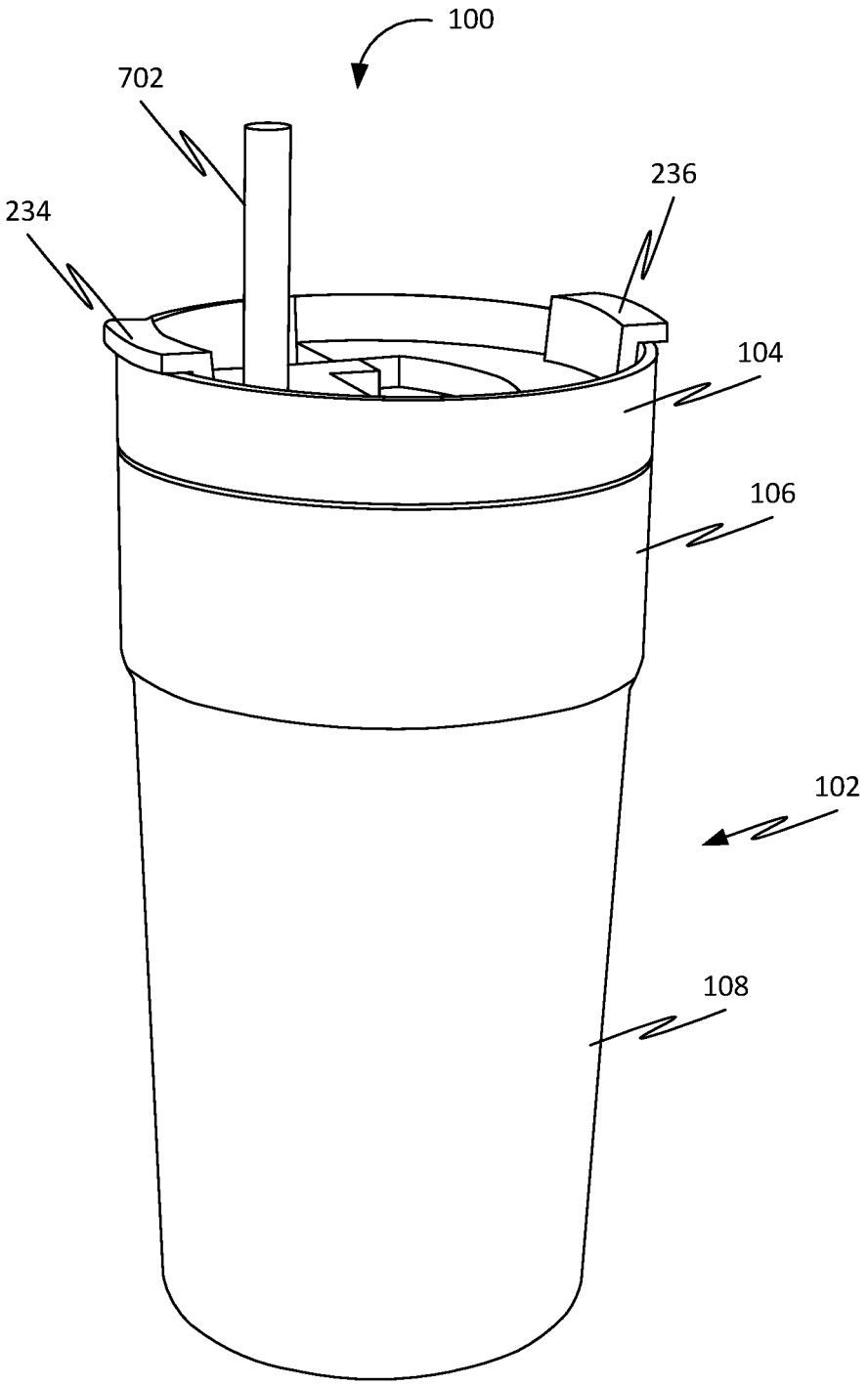
FIG. 7 is a side perspective view of the container 100, in accordance with some embodiments.

Further, in some embodiments, the container cover 104 may include a plurality of mechanisms 234-236 coupled with the plurality of cover openings 218-220, as shown in FIG. 2. Further, the plurality of mechanisms 234-236 may be configured for transitioning the plurality of cover openings 218-220 between a closed state and an opened state. Further, the plurality of mechanisms 234-236 restricts the independently retrieving from the plurality of cover openings 218-220 in the closed state. Further, the plurality of mechanisms 234-236 allows the independently retrieving from the plurality of cover openings 218-220 in the opened state. Further, the plurality of mechanisms 234-236 may include lid mechanisms. Further, the plurality of mechanisms 234-236 movably coupled to a top surface of the container cover 104. Further, the plurality of mechanisms 234-236 moves between a plurality of positions based on at least one external action for the transitioning of the plurality of cover openings 218-220 between the closed state and the opened state. Further, at least one of the plurality of mechanisms 234-236 may be configured for incorporating at least one sipping element 702, as shown in FIG. 7, in at least one of the plurality of mechanisms 234-236. Further, the at least one sipping element 702 may be a straw, a pipe, etc. Further, the plurality of mechanisms 234-236 may include a lid pivotally coupled to the container cover 104 using a coupling mechanism (hinge). Further, the lid may include a lid hole. Further, the at least one sipping element may inserted into at least one of the plurality of chambers 208-210 through the lid hole, at least one of the plurality of cover openings 218-220, and at least one of the plurality of openings 212-214.

Further, in some embodiments, the exterior wall 202, the plurality of interior walls 204-206, and the base wall 216 may be comprised of at least one thermally insulating material. Further, the at least one thermally insulating material may include fiberglass, expanded polystyrene (EPS), extruded polystyrene (XPS), etc.

Further, in some embodiments, the container cover 104 may be configured for forming at least one hermetic seal with the neck portion 106 for hermetically isolating each of the plurality of chambers 208-210 from the plurality of chambers 208-210 based on the coupling of the container cover 104 with the neck portion 106 of the container body 102.

Further, in an embodiment, the container cover 104 may include at least one hermetic seal creating element 304-308, as shown in FIG. 3. Further, the at least one hermetic seal creating element 304-308 may be configured for interfacing with a top surface 310 of the base wall 216 around the plurality of openings 212-214 based on the coupling of the container cover 104 with the neck portion 106 of the container body 102. Further, the forming of the at least one hermetic seal may be based on the interfacing. Further, the at least one seal creating element 304-308 may be coated with at least one material. Further, the at least one seal creating element 304-308 may removably attach to the top surface 310 based on the at least one material. Further, the at least one material may be removable and reusable adhesives.

Further, in some embodiments, at least one of the container body 102 and the container cover 104 may include at least one ergonomic feature on an exterior surface of at least one of the container body 102 and the container cover 104 for facilitating holding the container 100. Further, the at least one ergonomic feature corresponds to an exterior shape of at least one of the container body 102 and the container cover 104. Further, the holding of the container 100 may include holding the container 100 in a hand of a user (individual), holding the container 100 in a cup holder, holding the container 100 in a bag, etc.

Further, in some embodiments, the plurality of chambers 208-210 may include a first chamber 208 and a second chamber 210. Further, the plurality of interior walls 204-206 may include a first interior wall 204 forming the first chamber 208 and a second interior wall 206 forming the second chamber 210. Further, the first interior wall 204 may be comprised of at least one first material and the second interior wall 206 may be comprised of at least one second material. Further, the at least one first material has a low thermal conductivity and a low thermal emissivity. Further, the at least one second material has a low thermal conductivity and a high thermal reflectivity. Further, the at least one first material may include aerogel composite materials, silica aerogel composite materials, ceramic fiber materials, metalized films, etc. Further, the at least one first material may include a first layer of material with a low thermal emissivity and a second layer of material adjacent to the first layer of material having a low thermal conductivity. Further, the at least one second material may include reflective foil insulation, aluminized Mylar films, metalized films, metal-coated insulators, ceramic-coated insulators, etc. Further, the at least one second material may include a first layer of material with a high thermal reflectivity and a second layer of material adjacent to the first layer of material having a low thermal conductivity. Further, the first chamber 208 may be configured for storing a first substance of the plurality of substances with a first temperature based on the at least one first material and the second chamber 210 may be configured for storing a second substance of the plurality of substances with a second temperature based on the at least one second material. Further, the first temperature may be higher than the second temperature.

Figure 4:
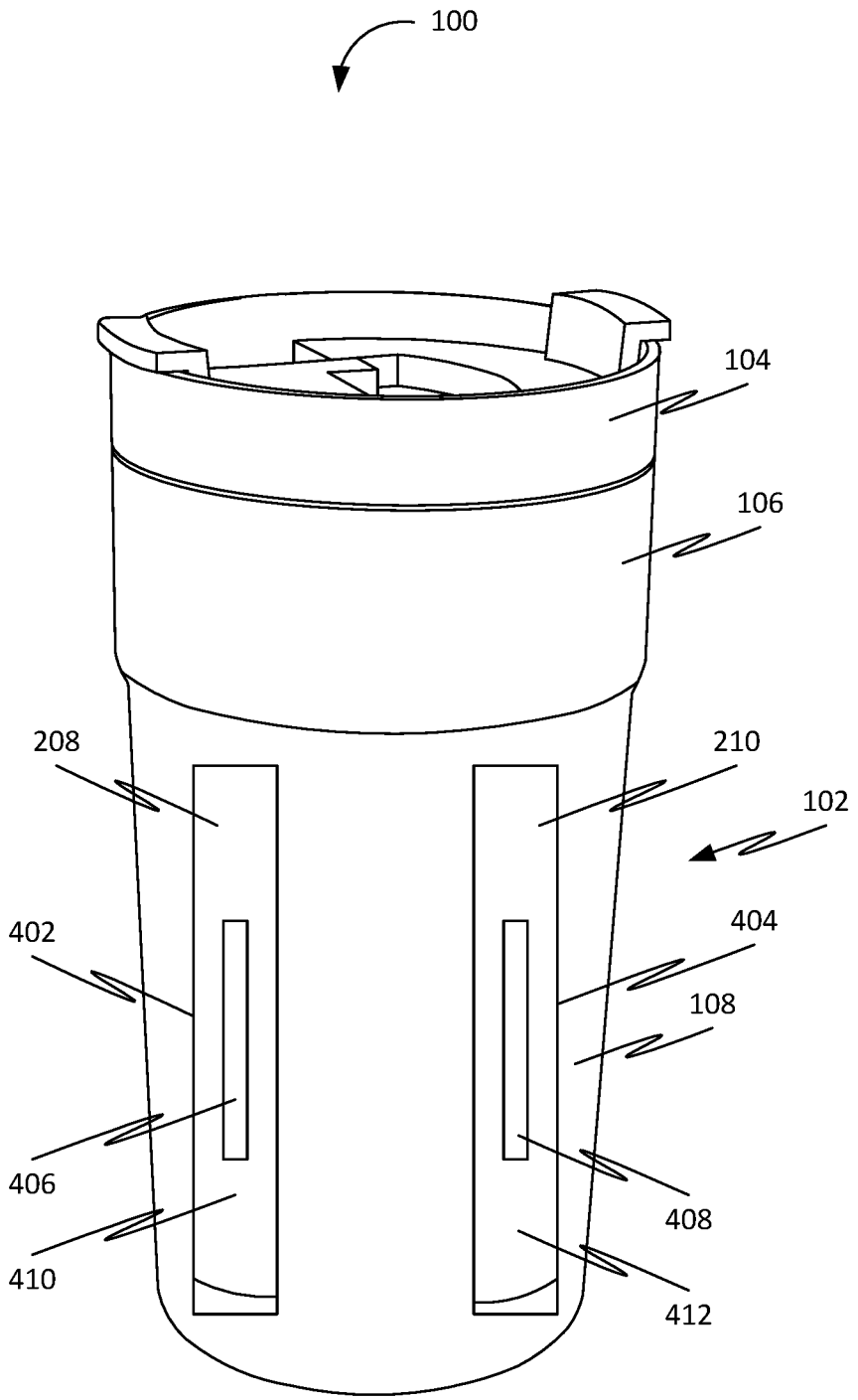
FIG. 4 is a side perspective view of the container 100, in accordance with some embodiments.

Further, in some embodiments, the exterior wall 202 may include a transparent portion (402 and 404) corresponding to each of the plurality of chambers 208-210, as shown in FIG. 4. Further, each of the plurality of interior walls 204-206 may include a layer of thermochromic material on a portion (406 and 408) of an exterior surface (410 and 412) of each of the plurality of interior walls 204-206, as shown in FIG. 4. Further, the portion (406 and 408) of the exterior surface (410 and 412) with the layer of thermochromic material may be visible through the transparent portion (402 and 404). Further, the thermochromic material may be organic leuco-dye mixtures. Further, the thermochromic material may be a reversible thermochromic material.

Figure 5:
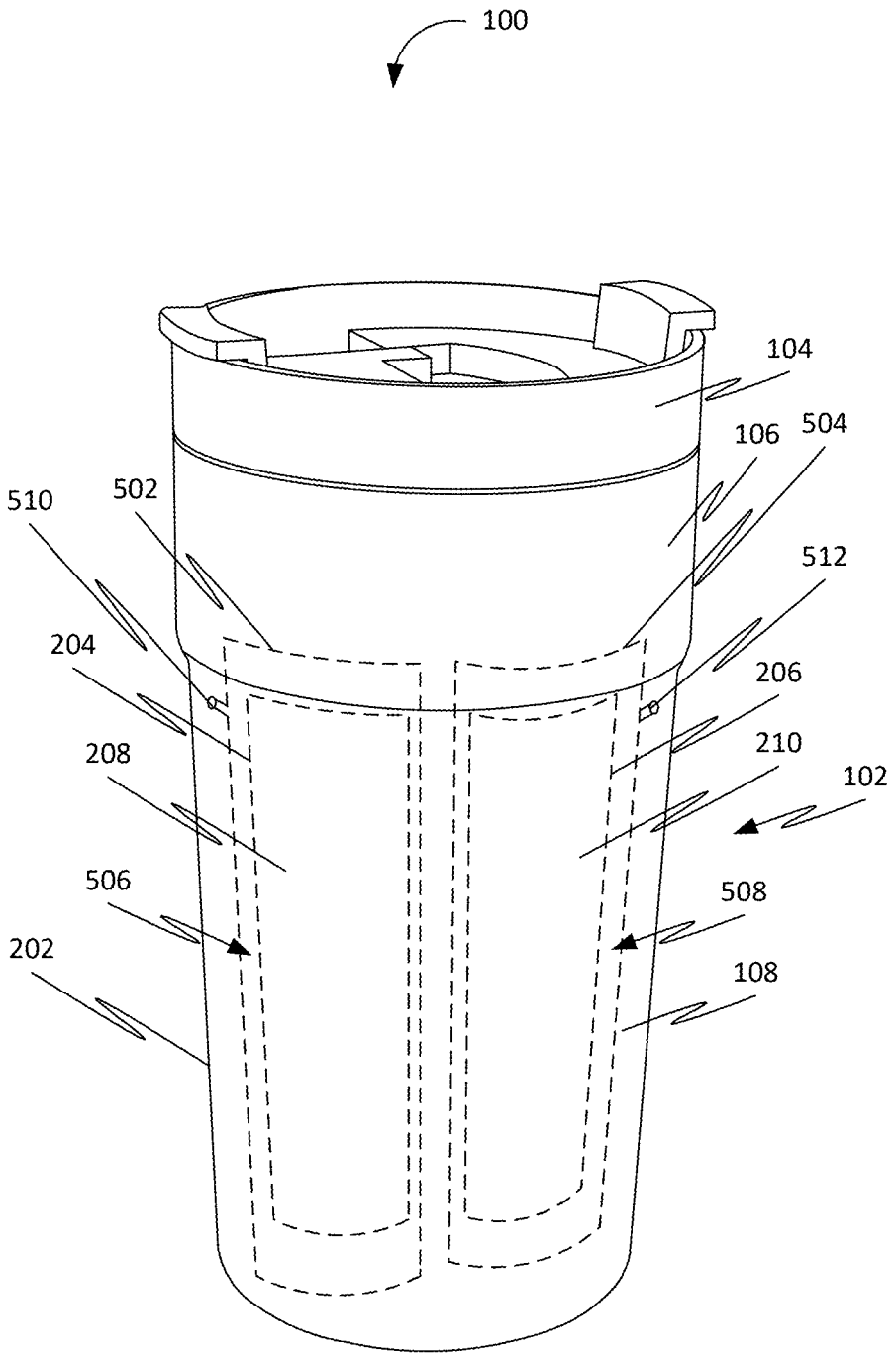
FIG. 5 is a side perspective view of the container 100, in accordance with some embodiments.

In further embodiments, the container 100 may include a plurality of enclosures 502-504 configured for spacedly enclosing the plurality of chambers 208-210 formed by the plurality of interior walls 204-206 for forming an enclosing space (506 and 508) between an exterior of each of the plurality of chambers 208-210 and an interior of each of the plurality of enclosures 502-504, as shown in FIG. 5. Further, each of the plurality of enclosures 502-504 may be thermally isolated from the plurality of enclosures 502-504 and the exterior wall 202. Further, the each of the plurality of enclosures 502-504 may be associated with a port (510 and 512) comprised on the exterior wall 202 and extend into each of the plurality of enclosures 502-504, as shown in FIG. 5. Further, each of the plurality of enclosures 502-504 may be configured for receiving at least one first substance in the enclosing space (506 and 508) through the port (510 and 512) for facilitating a heat transfer with each of the plurality of substances stored in each of the plurality of chambers 208-210. Further, the heat transfer regulates the temperature of each of the plurality of substances. Further, a temperature of the at least one first substance may facilitate the heat transfer. Further, the port (510 and 512) may be a pipe, a tube, a channel, etc., with an inlet and an outlet. Further, the outlet may be comprised on an exterior surface of the exterior wall 202 and the inlet may be coupled with each of the plurality of enclosures 502-504. Further, the plurality of interior walls 204-206 may be comprised of at least one thermally conducting material. Further, the at least one thermally conducting material may include metals. Further, the plurality of enclosures 502-504 and the exterior wall 202 may be comprised of at least one thermally insulating material.

Further, in an embodiment, the enclosing space (506 and 508) may include at least one second of substance stored in the enclosing space (506 and 508). Further, the at least one first substance chemically reacts with the at least one second substance based on the receiving for producing a product. Further, the facilitating of the heat transfer may be based on the producing of the product. Further, the at least one first substance and the at least one second substance may react either endothermically or exothermally for either releasing heat or absorbing heat which either increases a temperature of the product or decreases the temperature of the product. Further, the temperature of the product may facilitate the heat transfer.

FIG. 2 is a side perspective cross-sectional view of the container 100, in accordance with some embodiments.

FIG. 3 is a side perspective cross-sectional view of the container 100, in accordance with some embodiments.

FIG. 4 is a side perspective view of the container 100, in accordance with some embodiments.

FIG. 5 is a side perspective view of the container 100, in accordance with some embodiments.

Figure 6:
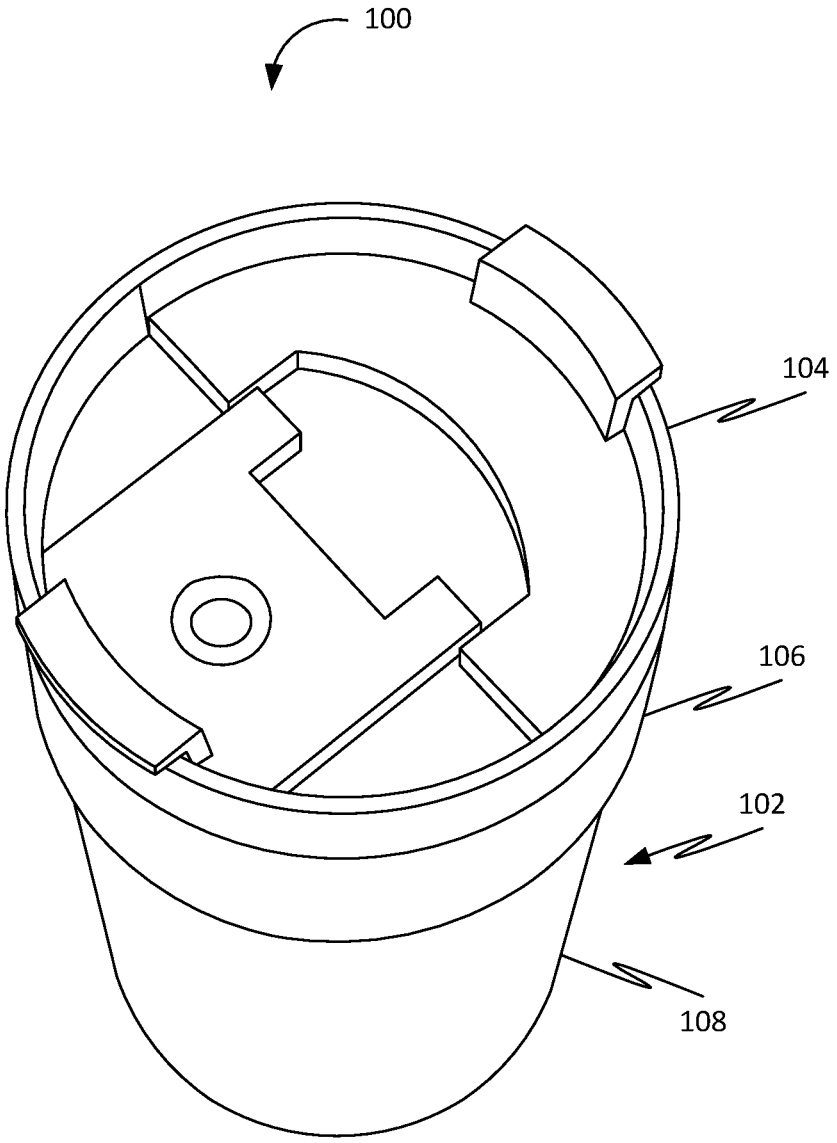
FIG. 6 is a top perspective view of the container 100, in accordance with some embodiments.

FIG. 6 is a top perspective view of the container 100, in accordance with some embodiments.

FIG. 7 is a side perspective view of the container 100, in accordance with some embodiments.

Figure 8:
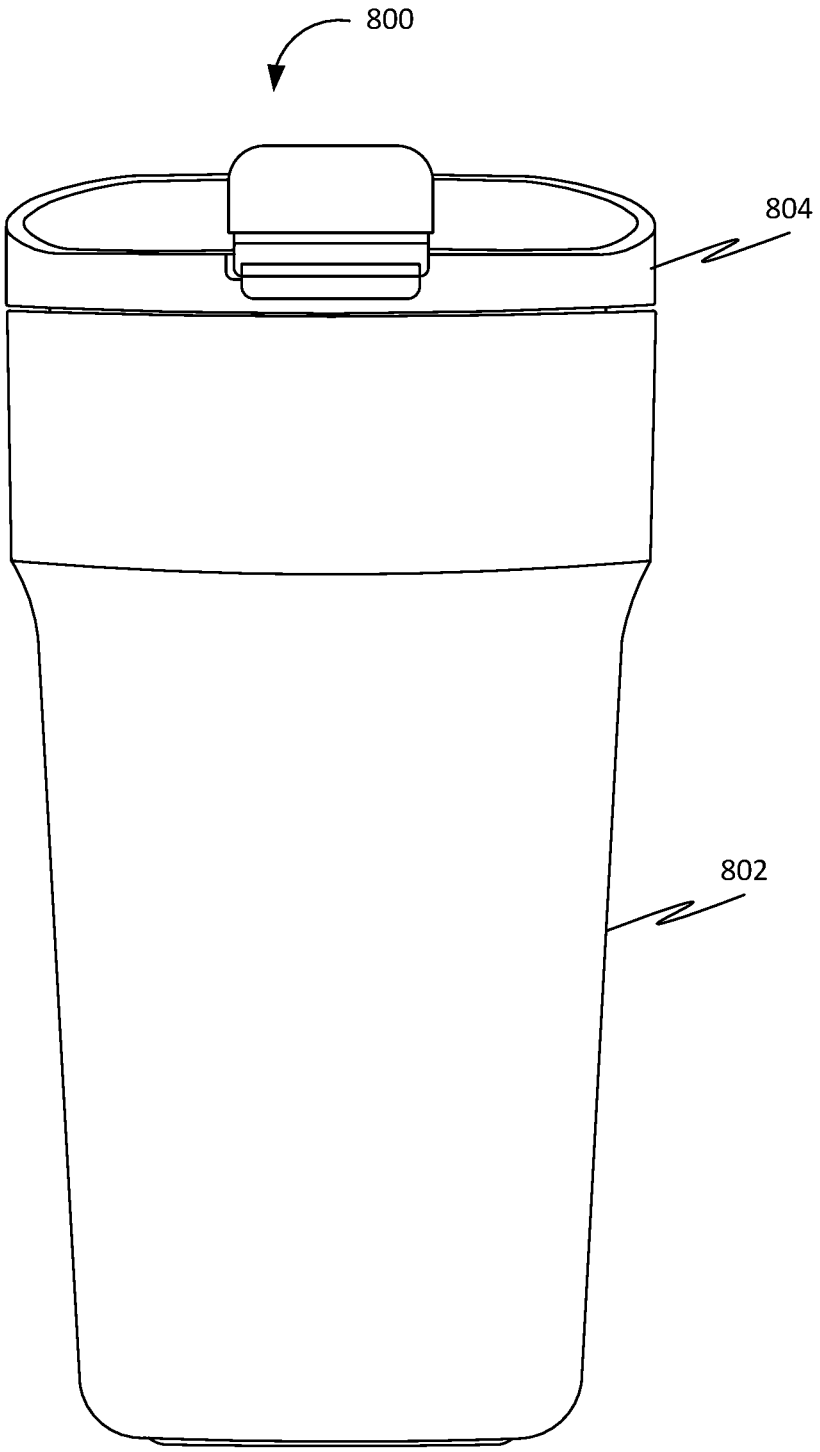
FIG. 8 is a front view of a container 800 for retrievably storing substances and retaining temperatures of the substances, in accordance with some embodiments.

FIG. 8 is a front view of a container 800 for retrievably storing substances and retaining temperatures of the substances, in accordance with some embodiments. Further, the container 800 may include a container body 802 and a container cover 804 coupled with the container body 802. Further, a width of the container 800 at a top end of the container 800 may be 100 mm and a length of the container 800 at the top end of the container 800 may be 105 mm. Further, a width of the container 800 at a bottom end of the container 800 may be 78 mm. Further, a height of the container 800 from the top end to the bottom end may be 200 mm.

Figure 9:
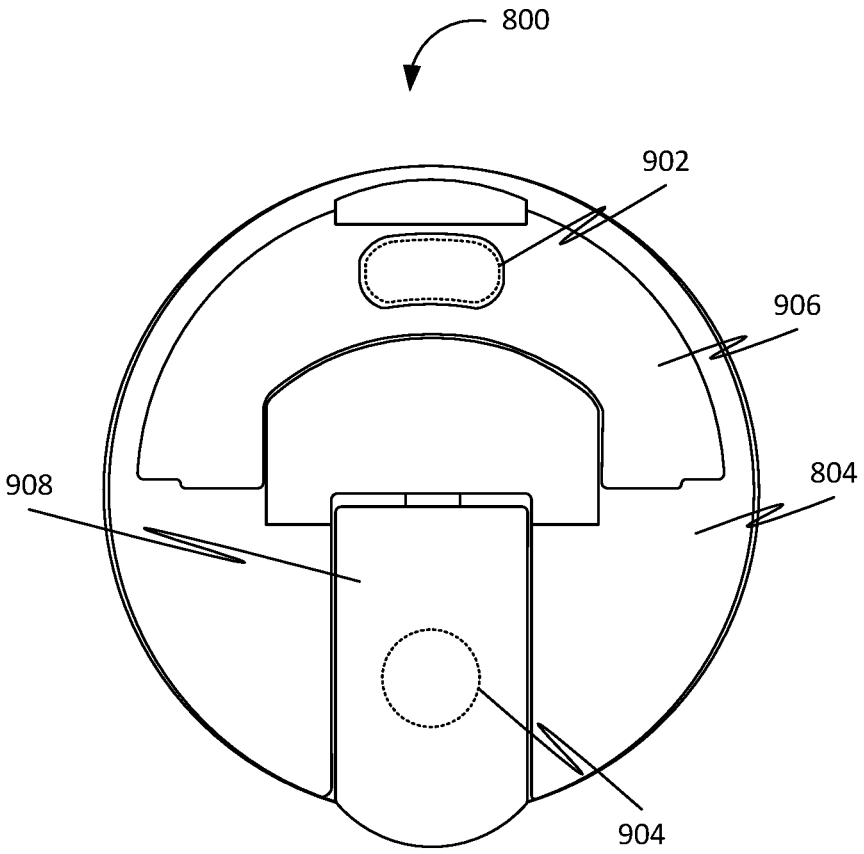
FIG. 9 is a top view of the container 800, in accordance with some embodiments.

FIG. 9 is a top view of the container 800, in accordance with some embodiments. Further, the container cover 804 may include a plurality of cover openings 902-904. Further, the container cover 804 may include a plurality of mechanisms 906-908 coupled with the plurality of cover openings 902-904.

Figure 10:
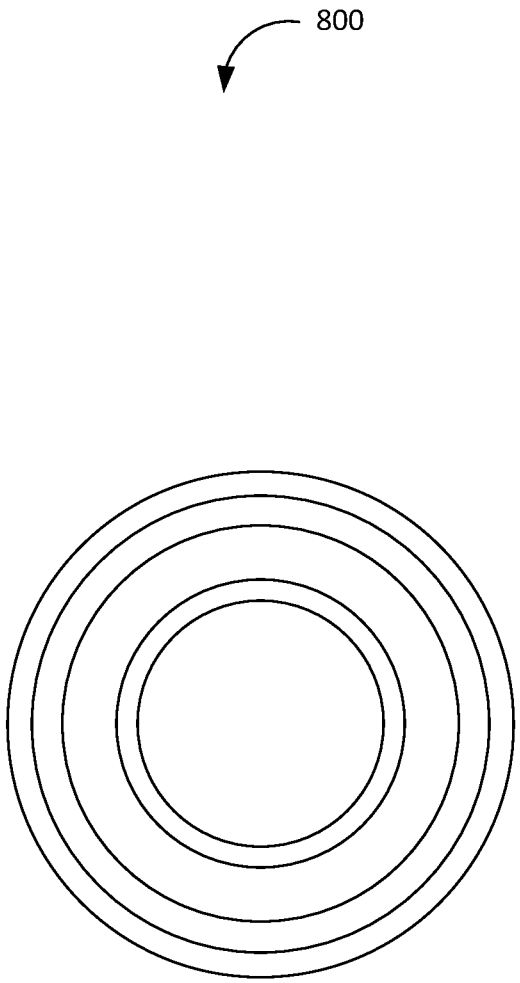
FIG. 10 is a bottom view of the container 800, in accordance with some embodiments.

FIG. 10 is a bottom view of the container 800, in accordance with some embodiments.

Figure 11:
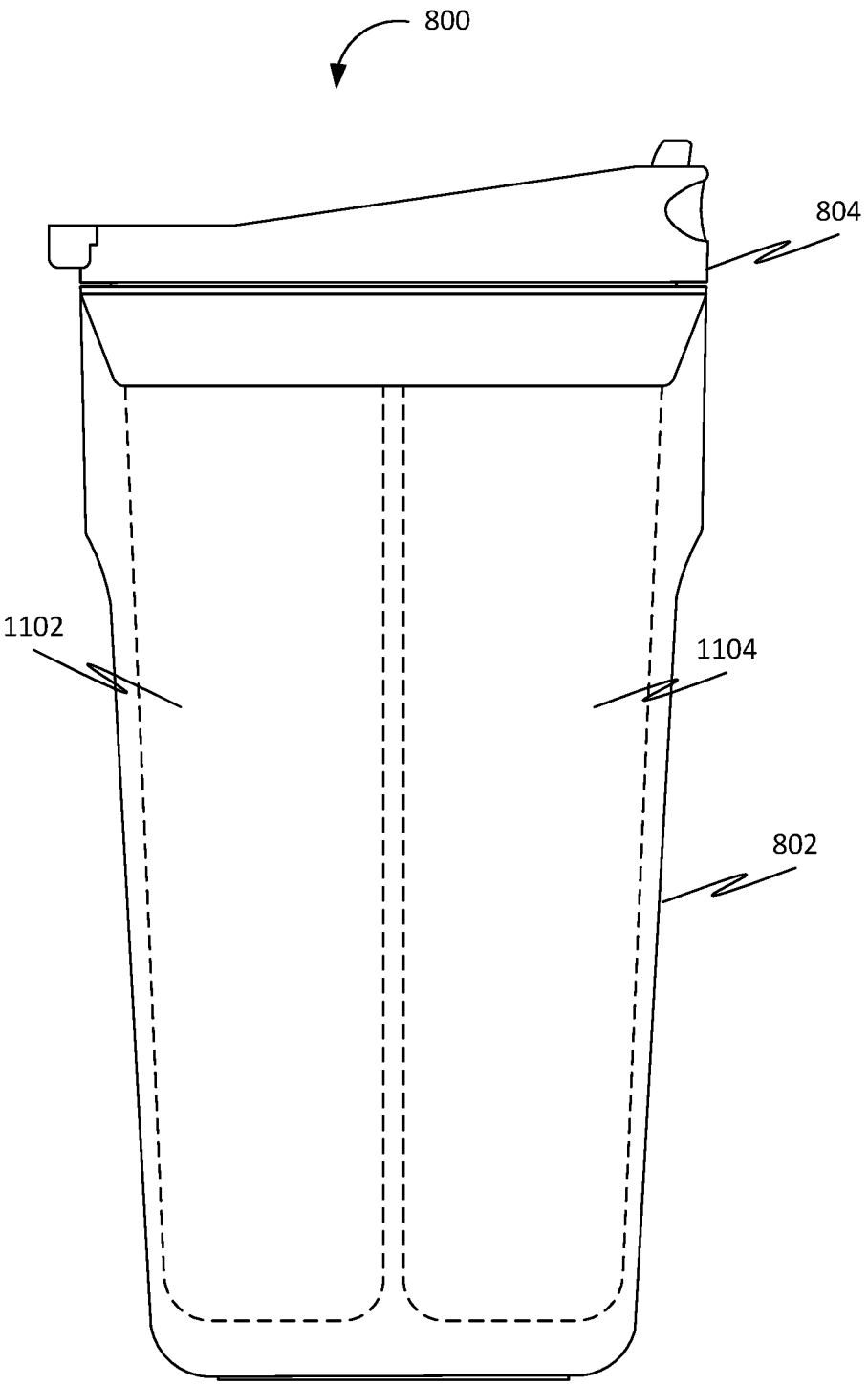
FIG. 11 is a side view of the container 800, in accordance with some embodiments.

FIG. 11 is a side view of the container 800, in accordance with some embodiments. Further, the container body 802 may include a plurality of chambers 1102-1104. Further, the plurality of chambers 1102-1104 may be configured for storing a plurality of substances.

Figure 12:
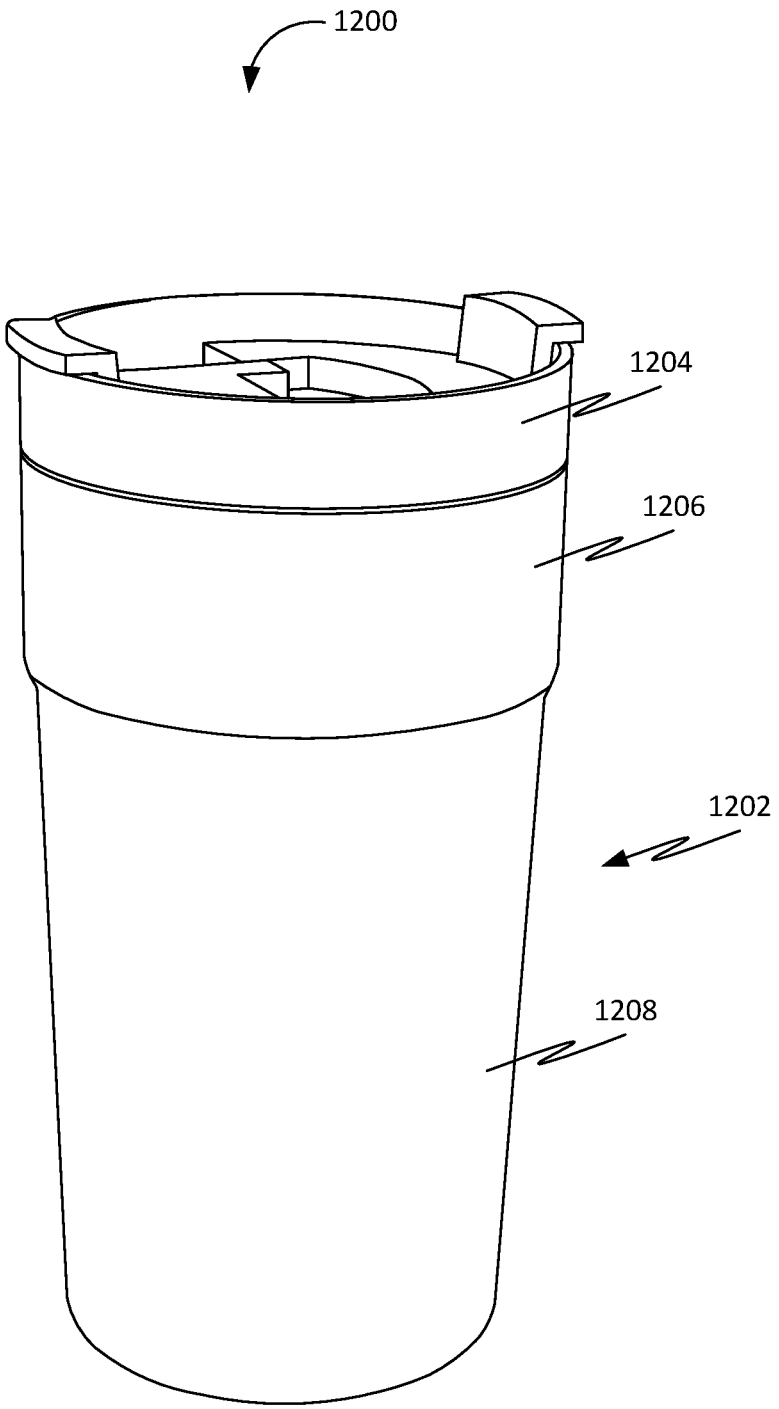
FIG. 12 is a side perspective view of a container 1200 for retrievably storing substances and retaining temperatures of the substances, in accordance with some embodiments.

FIG. 12 is a side perspective view of a container 1200 for retrievably storing substances and retaining temperatures of the substances, in accordance with some embodiments. Accordingly, the container 1200 may include a container body 1202 and a container cover 1204.

Further, the container body 1202 may include a neck portion 1206 and a body portion 1208. Further, the body portion 1208 may include a plurality of interior walls and an exterior wall disposed around the plurality of interior walls. Further, the plurality of interior walls forms a plurality of chambers within the body portion 1208. Further, the neck portion 1206 may include a plurality of openings corresponding to the plurality of chambers in a base wall of the neck portion 1206. Further, the plurality of openings leads into the plurality of chambers corresponding to the plurality of openings. Further, each of the plurality of interior walls may be thermally isolated from the plurality of interior walls and the exterior wall. Further, the plurality of chambers may be configured for storing a plurality of substances in the plurality of chambers received through the plurality of openings. Further, the plurality of interior walls and the exterior wall thermally isolate each of the plurality of substances stored in each of the plurality of chambers from the plurality of substances stored in the plurality of chambers and an exterior of the body portion 1208 for retaining a temperature of each of the plurality of substances. Further, each of the plurality of interior walls may be spaced from the plurality of interior walls and the exterior wall defining a space around an exterior of each of the plurality of chambers. Further, each of the plurality of interior walls may be thermally isolated from the plurality of interior walls and the exterior wall based on the space around the exterior of each of the plurality of chambers.

Further, the container cover 1204 may be configured to be coupled with the neck portion 1206 of the container body 1202. Further, the container cover 1204 may include a plurality of cover openings. Further, the plurality of cover openings couples with the plurality of openings based on the coupling of the container cover 1204 with the neck portion 1206. Further, the container cover 1204 may be configured for allowing an independent retrieval of the plurality of substances from the plurality of chambers through the plurality of cover openings.

Further, in some embodiments, a terminal end of each of the plurality of interior walls may be attached to the base wall peripherally around each of the plurality of openings and a terminal end of the exterior wall may be attached to a side wall of the neck portion 1206 for hermetically sealing the space around the exterior of each of the plurality of chambers.

Further, in an embodiment, the space around the exterior of each of the plurality of chambers may be a vacuum space. Further, each of the plurality of interior walls may be thermally isolated from the plurality of interior walls and the exterior wall based on the vacuum space.

Further, in some embodiments, the container cover 1204 may include a plurality of mechanisms coupled with the plurality of cover openings. Further, the plurality of mechanisms may be configured for transitioning the plurality of cover openings between a closed state and an opened state. Further, the plurality of mechanisms restricts the independently retrieving from the plurality of cover openings in the closed state. Further, the plurality of mechanisms allows the independently retrieving from the plurality of cover openings in the opened state.

Further, in some embodiments, the container cover 1204 may be configured for forming at least one hermetic seal with the neck portion 1206 for hermetically isolating each of the plurality of chambers from the plurality of chambers based on the coupling of the container cover 1204 with the neck portion 1206 of the container body 1202.

Figure 13:
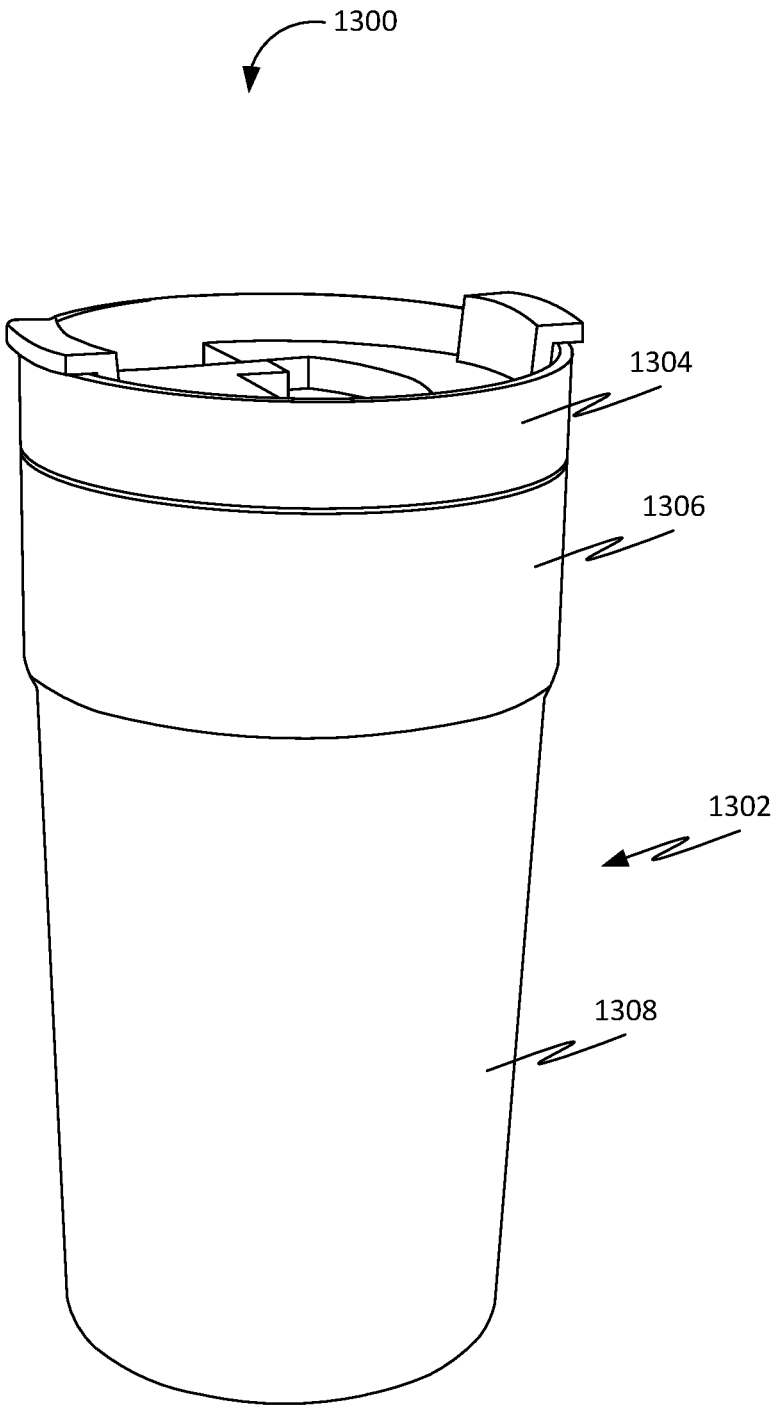
FIG. 13 is a side perspective view of a container 1300 for retrievably storing substances and retaining temperatures of the substances, in accordance with some embodiments.

FIG. 13 is a side perspective view of a container 1300 for retrievably storing substances and retaining temperatures of the substances, in accordance with some embodiments. Accordingly, the container 1300 may include a container body 1302 and a container cover 1304.

Further, the container body 1302 may include a neck portion 1306 and a body portion 1308. Further, the body portion 1308 may include a plurality of interior walls and an exterior wall disposed around the plurality of interior walls. Further, the plurality of interior walls forms a plurality of chambers within the body portion 1308. Further, the neck portion 1306 may include a plurality of openings corresponding to the plurality of chambers in a base wall of the neck portion 1306. Further, the plurality of openings leads into the plurality of chambers corresponding to the plurality of openings. Further, each of the plurality of interior walls may be thermally isolated from the plurality of interior walls and the exterior wall. Further, the plurality of chambers may be configured for storing a plurality of substances in the plurality of chambers received through the plurality of openings. Further, the plurality of interior walls and the exterior wall thermally isolate each of the plurality of substances stored in each of the plurality of chambers from the plurality of substances stored in the plurality of chambers and an exterior of the body portion 1308 for retaining a temperature of each of the plurality of substances. Further, each of the plurality of interior walls may be spaced from the plurality of interior walls and the exterior wall defining a space around an exterior of each of the plurality of chambers. Further, each of the plurality of interior walls may be thermally isolated from the plurality of interior walls and the exterior wall based on the space around the exterior of each of the plurality of chambers.

Further, the container cover 1304 may be configured to be coupled with the neck portion 1306 of the container body 1302. Further, the container cover 1304 may include a plurality of cover openings. Further, the plurality of cover openings couples with the plurality of openings based on the coupling of the container cover 1304 with the neck portion 1306. Further, the container cover 1304 may be configured for allowing an independent retrieval of the plurality of substances from the plurality of chambers through the plurality of cover openings. Further, the container cover 1304 may include a plurality of mechanisms coupled with the plurality of cover openings. Further, the plurality of mechanisms may be configured for transitioning the plurality of cover openings between a closed state and an opened state. Further, the plurality of mechanisms restricts the independently retrieving from the plurality of cover openings in the closed state. Further, the plurality of mechanisms allows the independently retrieving from the plurality of cover openings in the opened state.

Although the present disclosure has been explained in relation to its preferred embodiment, it is to be understood that many other possible modifications and variations can be made without departing from the spirit and scope of the disclosure.

What is claimed is:

1. A container for retrievably storing substances and retaining temperatures of the substances, the container comprising:

a container body comprising a neck portion and a body portion, wherein the body portion comprises a plurality of interior walls and an exterior wall disposed around the plurality of interior walls, wherein the plurality of interior walls forms a plurality of chambers within the body portion, wherein the neck portion comprises a plurality of openings corresponding to the plurality of chambers in a base wall of the neck portion, wherein the plurality of openings leads into the plurality of chambers corresponding to the plurality of openings, wherein each of the plurality of interior walls is thermally isolated from other interior walls of the plurality of interior walls, wherein the plurality of chambers is configured for storing a plurality of substances in the plurality of chambers received through the plurality of openings, wherein the plurality of interior walls thermally isolate each of the plurality of substances stored in each of the plurality of chambers for retaining a temperature of each of the plurality of substances, wherein the exterior wall comprises a base wall portion and a side wall portion circumferentially extending from the base wall portion for forming an exterior container, wherein the base wall portion and the side wall portion of the exterior wall defines an interior space of the exterior container, wherein the plurality of chambers are formed in the interior space of the exterior container;

a plurality of enclosures configured for spacedly enclosing the plurality of chambers for forming an enclosing space between an exterior of each of the plurality of chambers and an interior of each of the plurality of enclosures, wherein the plurality of enclosures is disposed in the interior space of the exterior container, wherein the plurality of enclosures and the exterior container are comprised of at least one thermally insulating material, wherein the at least one thermally insulating material comprises at least one of fiberglass, expanded polystyrene (EPS), and extruded polystyrene (XPS), wherein each of the plurality of enclosures is thermally isolated from other enclosures of the plurality of enclosures, and the exterior container based on the at least one thermally insulating material of the plurality of enclosures and the exterior container, wherein the exterior container comprises a plurality of ports on the side wall portion of the exterior container, wherein each of the plurality of enclosures is associated with a corresponding port comprised on the side wall portion of the exterior container, wherein the corresponding port extends into the enclosing space of a respective one of the plurality of enclosures, wherein each of the plurality of enclosures is configured for receiving at least one first substance in the enclosing space through the corresponding port, wherein the plurality of interior walls forming the plurality of chambers is comprised of at least one thermally conducting material, wherein the at least one thermally conducting material comprises a metal, wherein the at least one first substance transfers heat with each of the plurality of substances stored in each of the plurality of chambers based on a temperature of the at least one first substance, and the at least one thermally conducting material of the plurality of interior walls; and a container cover configured to be coupled with the neck portion of the container body, wherein the container cover comprises a plurality of cover openings, wherein the plurality of cover openings couples with the plurality of openings based on the coupling of the container cover with the neck portion, wherein the container cover is configured for allowing an independent retrieval of the plurality of substances from the plurality of chambers through the plurality of cover openings.

2. The container of claim 1, wherein a terminal end of each of the plurality of interior walls is attached to the base wall peripherally around each of the plurality of openings and a terminal end of the exterior wall is attached to a side wall of the neck portion for hermetically sealing the interior space of the exterior container.

3. The container of claim 2, wherein the interior space of the exterior container is a vacuum space.

4. The container of claim 2 further comprising at least one thermally insulating material disposed in the interior space of the exterior container.

5. The container of claim 1, wherein the container cover comprises a plurality of mechanisms coupled with the plurality of cover openings, wherein the plurality of mechanisms is configured for transitioning the plurality of cover openings between a closed state and an opened state, wherein the plurality of mechanisms restricts the independently retrieving from the plurality of cover openings in the closed state, wherein the plurality of mechanisms allows the independently retrieving from the plurality of cover openings in the opened state, wherein the plurality of mechanisms is configured for incorporating at least one sipping element, wherein at least one of the plurality of mechanisms comprises a lid, wherein the lid is pivotally coupled to the container cover using a coupling mechanism, wherein the lid comprises a lid hole, wherein the at least one sipping element is inserted into at least one of the plurality of chambers through the lid hole, at least one of the plurality of cover openings, and at least one of the plurality of openings.

6. The container of claim 1, wherein the exterior wall, the plurality of interior walls, and the base wall are comprised of at least one thermally insulating material.

7. The container of claim 1, wherein the container cover is configured for forming at least one hermetic seal with the neck portion for hermetically isolating each of the plurality of chambers from the plurality of chambers based on the coupling of the container cover with the neck portion of the container body.

8. The container of claim 7, wherein the container cover comprises at least one hermetic seal creating element, wherein the at least one hermetic seal creating element is configured for interfacing with a top surface of the base wall around the plurality of openings based on the coupling of the container cover with the neck portion of the container body, wherein the forming of the at least one hermetic seal is based on the interfacing, wherein the at least one hermetic seal creating element is coated with at least one material, wherein the at least one hermetic seal creating element removably attaches to the top surface based on the at least one material, wherein the at least one material is at least one removable and reusable adhesive.

9. The container of claim 1, wherein at least one of the container body and the container cover comprises at least one ergonomic feature on an exterior surface of at least one of the container body and the container cover for facilitating holding the container, wherein the at least one ergonomic feature corresponds to an exterior shape of at least one of the container body and the container cover, wherein the holding of the container comprises holding the container in a cup holder.

10. The container of claim 1, wherein the plurality of chambers comprises a first chamber and a second chamber, wherein the plurality of interior walls comprises a first interior wall forming the first chamber and a second interior wall forming the second chamber, wherein the first interior wall is comprised of at least one first material and the second interior wall is comprised of at least one second material, wherein the first chamber is configured for storing a first substance of the plurality of substances with a first temperature based on the at least one first material and the second chamber is configured for storing a second substance of the plurality of substances with a second temperature based on the at least one second material, wherein the first temperature is higher than the second temperature, wherein the at least one first material comprises at least one of silica aerogel composite material and ceramic fiber material, wherein the at one second material comprises at least one of metalized film and metal-coated insulator.

11. The container of claim 1, wherein the exterior wall comprises a transparent portion corresponding to each of the plurality of chambers, wherein each of the plurality of interior walls comprises a layer of thermochromic material on a portion of an exterior surface of each of the plurality of interior walls, wherein the portion of the exterior surface with the layer of thermochromic material is visible through the transparent portion.

12. The container of claim 1, wherein the enclosing space comprises at least one second substance stored in the enclosing space, wherein the at least one first substance chemically reacts with the at least one second substance based on the receiving for producing a product, wherein the at least one first substance reacts either endothermically or exothermically with the at least one second substance for either releasing or absorbing heat for either increasing a temperature of the product or decreasing the temperature of the product, wherein the heat transfer is further based on the temperature of the product.

13. A container for retrievably storing substances and retaining temperatures of the substances, the container comprising:

a container body comprising a neck portion and a body portion, wherein the body portion comprises a plurality of interior walls and an exterior wall disposed around the plurality of interior walls, wherein the plurality of interior walls forms a plurality of chambers within the body portion, wherein the neck portion comprises a plurality of openings corresponding to the plurality of chambers in a base wall of the neck portion, wherein the plurality of openings leads into the plurality of chambers corresponding to the plurality of openings, wherein each of the plurality of interior walls is thermally isolated from other interior walls of the plurality of interior walls, wherein the plurality of chambers is configured for storing a plurality of substances in the plurality of chambers received through the plurality of openings, wherein the plurality of interior walls thermally isolate each of the plurality of substances stored in each of the plurality of chambers for retaining a temperature of each of the plurality of substances, wherein the exterior wall comprises a base wall portion and a side wall portion circumferentially extending from the base wall portion for forming an exterior container, wherein the base wall portion and the side wall portion of the exterior wall defines an interior space of the exterior container, wherein the plurality of chambers are formed in the interior space of the exterior container;

a plurality of enclosures configured for spacedly enclosing the plurality of chambers for forming an enclosing space between an exterior of each of the plurality of chambers and an interior of each of the plurality of enclosures, wherein the plurality of enclosures is disposed in the interior space of the exterior container, wherein the plurality of enclosures and the exterior container are comprised of at least one thermally insulating material, wherein the at least one thermally insulating material comprises at least one of fiberglass, expanded polystyrene (EPS), and extruded polystyrene (XPS), wherein each of the plurality of enclosures is thermally isolated from other enclosures of the plurality of enclosures, and the exterior container based on the at least one thermally insulating material of the plurality of enclosures and the exterior container, wherein the exterior container comprises a plurality of ports on the side wall portion of the exterior container, wherein each of the plurality of enclosures is associated with a corresponding port comprised on the side wall portion of the exterior container, wherein the corresponding port extends into the enclosing space of a respective one of the plurality of enclosures, wherein each of the plurality of enclosures is configured for receiving at least one first substance in the enclosing space through the corresponding port, wherein the plurality of interior walls forming the plurality of chambers is comprised of at least one thermally conducting material, wherein the at least one thermally conducting material comprises a metal, wherein the at least one first substance transfers heat with each of the plurality of substances stored in each of the plurality of chambers based on a temperature of the at least one first substance, and the at least one thermally conducting material of the plurality of interior walls; and a container cover configured to be coupled with the neck portion of the container body, wherein the container cover comprises a plurality of cover openings, wherein the plurality of cover openings couples with the plurality of openings based on the coupling of the container cover with the neck portion, wherein the container cover is configured for snugly fitting in a recess of the neck portion using an interference fit based on the coupling of the container cover with the neck portion, wherein the container cover is configured for allowing an independent retrieval of the plurality of substances from the plurality of chambers through the plurality of cover openings, wherein the container cover is configured for forming at least one hermetic seal with the neck portion for hermetically isolating each of the plurality of chambers from the plurality of chambers based on the coupling of the container cover with the neck portion of the container body, wherein the container cover comprises at least one hermetic seal creating element, wherein the at least one hermetic seal creating element is configured for interfacing with a top surface of the base wall around the plurality of openings based on the coupling of the container cover with the neck portion of the container body, wherein the forming of the at least one hermetic seal is based on the interfacing, wherein the at least one hermetic seal creating element is coated with at least one material, wherein the at least one hermetic seal creating element removably attaches to the top surface based on the at least one material, wherein the at least one material is at least one removable and reusable adhesive.

14. The container of claim 13, wherein a terminal end of each of the plurality of interior walls is attached to the base wall peripherally around each of the plurality of openings and a terminal end of the exterior wall is attached to a side wall of the neck portion for hermetically sealing the interior space of the exterior container.

15. The container of claim 14, wherein the interior space of the exterior container is a vacuum space.

16. The container of claim 13, wherein the container cover comprises a plurality of mechanisms coupled with the plurality of cover openings, wherein the plurality of mechanisms is configured for transitioning the plurality of cover openings between a closed state and an opened state, wherein the plurality of mechanisms restricts the independently retrieving from the plurality of cover openings in the closed state, wherein the plurality of mechanisms allows the independently retrieving from the plurality of cover openings in the opened state.

17. A container for retrievably storing substances and retaining temperatures of the substances, the container comprising:

a container body comprising a neck portion and a body portion, wherein the body portion comprises a plurality of interior walls and an exterior wall disposed around the plurality of interior walls, wherein the plurality of interior walls forms a plurality of chambers within the body portion, wherein the neck portion comprises a plurality of openings corresponding to the plurality of chambers in a base wall of the neck portion, wherein the plurality of openings leads into the plurality of chambers corresponding to the plurality of openings, wherein each of the plurality of interior walls is thermally isolated from other interior walls of the plurality of interior walls, wherein the plurality of chambers is configured for storing a plurality of substances in the plurality of chambers received through the plurality of openings, wherein the plurality of interior walls thermally isolate each of the plurality of substances stored in each of the plurality of chambers for retaining a temperature of each of the plurality of substances, wherein the exterior wall comprises a base wall portion and a side wall portion circumferentially extending from the base wall portion for forming an exterior container, wherein the base wall portion and the side wall portion of the exterior wall defines an interior space of the exterior container, wherein the plurality of chambers are formed in the interior space of the exterior container;

a plurality of enclosures configured for spacedly enclosing the plurality of chambers for forming an enclosing space between an exterior of each of the plurality of chambers and an interior of each of the plurality of enclosures, wherein the plurality of enclosures is disposed in the interior space of the exterior container, wherein the plurality of enclosures and the exterior container are comprised of at least one thermally insulating material, wherein the at least one thermally insulating material comprises at least one of fiberglass, expanded polystyrene (EPS), and extruded polystyrene (XPS), wherein each of the plurality of enclosures is thermally isolated from other enclosures of the plurality of enclosures, and the exterior container based on the at least one thermally insulating material of the plurality of enclosures and the exterior container, wherein the exterior container comprises a plurality of ports on the side wall portion of the exterior container, wherein each of the plurality of enclosures is associated with a corresponding port comprised on the side wall portion of the exterior container, wherein the corresponding port extends into the enclosing space of a respective one of the plurality of enclosures, wherein each of the plurality of enclosures is configured for receiving at least one first substance in the enclosing space through the corresponding port, wherein the plurality of interior walls forming the plurality of chambers is comprised of at least one thermally conducting material, wherein the at least one thermally conducting material comprises a metal, wherein the at least one first substance transfers heat with each of the plurality of substances stored in each of the plurality of chambers based on a temperature of the at least one first substance, and the at least one thermally conducting material of the plurality of interior walls; and a container cover configured to be coupled with the neck portion of the container body, wherein the container cover comprises a plurality of cover openings, wherein the plurality of cover openings couples with the plurality of openings based on the coupling of the container cover with the neck portion, wherein the container cover is configured for snugly fitting in a recess of the neck portion using an interference fit based on the coupling of the container cover with the neck portion, wherein the container cover is configured for allowing an independent retrieval of the plurality of substances from the plurality of chambers through the plurality of cover openings, wherein the container cover comprises a plurality of mechanisms coupled with the plurality of cover openings, wherein the plurality of mechanisms is configured for transitioning the plurality of cover openings between a closed state and an opened state, wherein the plurality of mechanisms restricts the independently retrieving from the plurality of cover openings in the closed state, wherein the plurality of mechanisms allows the independently retrieving from the plurality of cover openings in the opened state, wherein the plurality of mechanisms is configured for incorporating at least one sipping element, wherein at least one of the plurality of mechanisms comprises a lid, wherein the lid is pivotally coupled to the container cover using a coupling mechanism, wherein the lid comprises a lid hole, wherein the at least one sipping element is inserted into at least one of the plurality of chambers through the lid hole, at least one of the plurality of cover openings, and at least one of the plurality of openings.

* * * * *